US007352983B2

(12) United States Patent
Kamiya et al.

(10) Patent No.: US 7,352,983 B2
(45) Date of Patent: Apr. 1, 2008

(54) DEVELOPMENT MAGNET ROLLER, DEVELOPMENT DEVICE, PROCESS CARTRIDGE AND IMAGE FORMING APPARATUS

(75) Inventors: Noriyuki Kamiya, Yokohama (JP); Takahiro Yasunaga, Ebina (JP); Tsuyoshi Imamura, Sagamihara (JP); Sumio Kamoi, Tokyo (JP); Kyohta Koetsuka, Fujisawa (JP); Mieko Kakegawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 244 days.

(21) Appl. No.: 10/911,582

(22) Filed: Aug. 5, 2004

(65) Prior Publication Data

US 2005/0063738 A1 Mar. 24, 2005

(30) Foreign Application Priority Data

Aug. 5, 2003 (JP) ..... 2003-286485

(51) Int. Cl.
*G03G 15/09* (2006.01)

(52) U.S. Cl. ..... 399/277

(58) Field of Classification Search ..... 399/277, 399/252, 200, 222, 265
See application file for complete search history.

(56) References Cited

U.S. PATENT DOCUMENTS 4,793,691 A 12/1988 Enomoto et al.
4,984,873 A 1/1991 Takiguchi et al.
5,044,733 A 9/1991 Kamoi et al.
5,244,741 A 9/1993 Nagano et al.
5,296,328 A * 3/1994 Fuji et al. ..... 399/267 X
5,513,026 A 4/1996 Suzuki et al.
5,566,013 A 10/1996 Suzuki et al.
5,970,294 A 10/1999 Narita et al.
6,070,038 A 5/2000 Imamura et al.
6,112,042 A 8/2000 Imamura et al.
6,125,255 A * 9/2000 Litman et al. ..... 399/277
6,198,859 B1 3/2001 Tsuda et al.
6,262,787 B1 7/2001 Kamoi et al.
6,287,264 B1 9/2001 Yoshii et al.

(Continued)

FOREIGN PATENT DOCUMENTS

JP 7-319282 12/1995

(Continued)

OTHER PUBLICATIONS

U.S. Appl. No. 11/353,119, Feb. 14, 2006, Imamura.

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

A development magnet roller for use in a development roller of an electrophotographic image forming apparatus is provided. The development magnet roller has a development pole to form a magnetic field causing a developer born on a surface of the development roller including the development magnet roller to rise in a form of a series of ears in a development area of the image forming apparatus where the development roller opposes an image bearing member, and in a magnetic flux density distribution in a normal line direction of the development pole, a peak magnetic flux density is 120 mT or greater, a zero gauss region width is 70° or greater, and a half-value region width is 40° or smaller.

52 Claims, 5 Drawing Sheets

U.S. PATENT DOCUMENTS

| | | | |
|---|---|---|---|
| 6,330,415 | B1 | 12/2001 | Imamura et al. |
| 6,337,957 | B1 | 1/2002 | Tamaki et al. |
| 6,379,759 | B2 | 4/2002 | Kamoi et al. |
| 6,522,855 | B1 | 2/2003 | Katoh et al. |
| 6,697,593 | B2 | 2/2004 | Imamura et al. |

FOREIGN PATENT DOCUMENTS

| | | | | |
|---|---|---|---|---|
| JP | 08-15988 | | | 1/1996 |
| JP | 8-30103 | | | 2/1996 |
| JP | 2703992 | | | 10/1997 |
| JP | 11095558 | A | * | 4/1999 |
| JP | 2000068120 | A | * | 3/2000 |
| JP | 2000-305360 | | | 11/2000 |
| JP | 2001-027849 | | | 1/2001 |
| JP | 2002110408 | A | * | 4/2002 |
| JP | 2002-268386 | | | 9/2002 |
| JP | 2003-215927 | | | 7/2003 |
| JP | 2003-215928 | | | 7/2003 |

* cited by examiner

| | magnetic flux density [mT] | half-value region width [deg] | zero gauss region width [deg] | half-value region center angle shifting distance [deg] | magnet block protrusion amount [mm] | carrier adhesion rank | trailing edge omission rank |
|---|---|---|---|---|---|---|---|
| Ex. 1 | 132 | 31 | 54 | 1 | 0.25 | X | ○ |
| Ex. 2 | 128 | 33 | 59 | 1 | 0.25 | □ | ○ |
| Ex. 3 | 127 | 34 | 64 | 1 | 0.25 | □ | ○ |
| Ex. 4 | 133 | 33 | 71 | 1 | 0.25 | ○ | ○ |
| Ex. 5 | 132 | 33 | 76 | 1 | 0.25 | ○ | ○ |
| Ex. 6 | 131 | 34 | 79 | 1 | 0.25 | ○ | ○ |
| Ex. 7 | 129 | 33 | 76 | 3 | 0.25 | □ | ○ |
| Ex. 8 | 126 | 33 | 76 | 5 | 0.25 | □ | ○ |
| C.Ex.1 | 115 | 41 | 68 | 0 | 0 | X | X |
| C.Ex.2 | 103 | 45 | 65 | 0 | magnet block is not buried | X | X |

FIG. 5

DEVELOPMENT MAGNET ROLLER, DEVELOPMENT DEVICE, PROCESS CARTRIDGE AND IMAGE FORMING APPARATUS

CROSS-REFERENCE TO RELATED APPLICATIONS

The present application claims priority and contains subject matter related to Japanese Patent Application No. 2003-286485 filed in the Japanese Patent Office on Aug. 5, 2003, and the entire contents of which are hereby incorporated herein by reference.

BACKGROUND OF THE INVENTION

1. Field of the Invention

The present invention relates to an image forming apparatus of electrophotography such as copiers, facsimile apparatuses and printers, and more particularly relates to a two-component development device in which a two-component developer born on the surface of a development roller is caused to rise in a form of a series of ears to contact a latent image bearing member and thereby a latent image on the latent image bearing member is visualized with toner of the developer.

2. Discussion of the Background

Two-component development devices using a two-component developer in which magnetic particles called carriers and toner are mixed are widely used in image forming apparatuses. Improvement in reliability and enhancement of image quality are demanded in image forming apparatuses, and in particular decreasing carrier adhesion is demanded for improving reliability and decreasing trailing edge omission is demanded for improving image quality.

In a two-component development device, a two-component developer including carriers and toner is born on the surface of a development roller, and in a development area where the development roller faces an electrostatic latent image bearing member, the developer born on the surface of the development roller is caused to rise in a form of a series of ears to contact the latent image bearing member and thereby a latent image on the latent image bearing member is developed with toner of the developer into a toner image. At this time, an electric force from the latent image bearing member and a magnetic force from the development roller are applied to carriers of the developer, and if the electric force from the latent image bearing member is greater than the magnetic force from the development roller, carriers that must remain on the development roller move together with toner and adhere to the latent image bearing member. This phenomenon is called carrier adhesion. When the toner image formed on the latent image bearing member is transferred onto a transfer sheet by a transfer device, the carriers adhered to the latent image bearing member are transferred to the transfer sheet together with the toner forming the toner image. This causes adverse effects to the transfer device. Further, when the toner image transferred onto the transfer sheet is fixed onto the sheet by a fixing device, the carriers transferred to the transfer sheet are also fixed to the sheet. This causes adverse effects to the fixing device. Thus, carrier adhesion is a factor decreasing reliability of an image forming apparatus.

To avoid carrier adhesion, it is conceivable to decrease the electric force applied to the carriers from the latent image bearing member by adjusting the charging potential of the latent image bearing member and the potential of the development roller, which, however, causes other problems in an image such as background soiling, etc.

A method of avoiding carrier adhesion is proposed in Japanese Patent Laid-open publication No. 8-15988, in which a magnetic flux density distribution curve in a development area is formed such that a width in a circumferential direction of a development sleeve of a development roller is narrower at the peak point side. By making the magnetic flux density in the development area locally larger, the action direction of a magnetic attraction force applied to carriers from the development roller is greatly changed. This results not only in that the magnetic attraction force from the development roller is made stronger than the electric force of a latent image bearing member, but also in that a rotation force acts on the carriers. Thereby, the attraction balance between the latent image bearing member and the carriers is rapidly lost, so that carrier adhesion is avoided.

A development roller in a two-component development device conveys a developer born on the surface of the development roller in a circumferential direction thereof, and the developer is caused to rise in a form of a series of ears at a part of the development roller coming close to a latent image bearing member. The ears of the developer have some widths in the circumferential direction of the development roller, and an electrostatic latent image on the latent image bearing member is developed with toner of the developer while the ears of the developer rub the latent image bearing member. At this time, if the widths of the ears of the developer are too large, a phenomenon that toner once moved to the latent image bearing member is scraped off the latent image bearing member occurs. This phenomenon is called trailing edge omission, and is a factor of deteriorating image quality. The trailing edge omission phenomenon is more noticeable as the widths of ears of the developer are wider.

The applicant of the present invention has proposed, for example, in JP Laid-open publications No. 2000-305360 and No. 2001-27849, a method of avoiding a trailing edge omission phenomenon by narrowing a half-value region width of a magnetic flux density distribution in a normal line direction of a development pole while making the magnetic flux density of the development pole relatively large. The half-value region width refers to an angular width at parts of a magnetic force distribution curve indicating values corresponding to one-half of the maximum (peak) normal line magnetic force. In the proposed method, however, because the attenuation ratio of magnetic flux density in the normal line direction of a development pole is relatively high (e.g., 40% or greater), depending upon the states of magnetic poles at the upstream and downstream sides relative to the development pole in the circumferential direction of a development sleeve of a development roller, a relatively large plunge is generated in the waveform of a magnetic force of the development pole and thereby carrier adhesion is occasionally caused.

SUMMARY OF THE INVENTION

The present invention has been made in views of the above-discussed and other problems and addresses the above-discussed and other problems.

Preferred embodiments of the present invention provide a novel development magnet roller, for use in a development device of an electrophotographic image forming apparatus, that has a development pole with a magnetic waveform characteristic enabling improvement in trailing edge omission while suppressing carrier adhesion.

Preferred embodiments of the present invention further provide a novel development device including the development magnet roller, a novel process cartridge including the development device, and a novel image forming apparatus including the development device.

According to a preferred embodiment of the present invention, a development magnet roller for use in a development roller of an electrophotographic image forming apparatus is provided. The development magnet roller has a development pole to form a magnetic field causing a developer born on a surface of the development roller including the development magnet roller to rise in a form of a series of ears in a development area of the image forming apparatus where the development roller opposes an image bearing member, and in a magnetic flux density distribution in a normal line direction of the development pole, a peak magnetic flux density is 120 mT or greater, a zero gauss region width is 70° or greater, and a half-value region width is 40° or smaller. Thereby, while obtaining a relatively large surface magnetic force of the development roller necessary for development, by making a zero gauss region width in the magnetic flux density distribution in the normal line direction of the development pole relatively large, carrier adhesion can be suppressed, and at the same time, by narrowing a half-value region width in the magnetic flux density distribution, trailing edge omission can be improved.

In the above-described development magnet roller, the magnetic flux density distribution in the normal line direction of the development pole may be formed such that a half-value region center angle is shifted 3° or more toward a downstream side of a zero gauss region center angle in a direction in which the developer born on the surface of the development roller is conveyed. Thereby, a magnetic force between the development pole and a downstream side pole is prevented from rapidly plunging, so that carrier adhesion can be further suppressed.

The above-described development magnet roller may be configured such that a magnet block is buried in the development magnet roller at a part thereof corresponding to the development pole. Thereby, adjusting the half-value region center angle relative to the zero gauss region center angle in the magnetic flux density distribution in the normal line direction of the development pole is facilitated.

In the development magnet roller described immediately above, a zero gauss region width in the magnetic flux density distribution in the normal line direction of the development pole before the magnet block is buried in the development magnet roller may be 70° or greater and a center line of the magnet block may be located 3° or more shifted toward a downstream side, in the direction in which the developer born on the surface of the development roller is conveyed, of the zero gauss region center angle of the magnetic flux density distribution in the normal line direction of the development pole before the magnet block is buried in the development magnet roller. Because the zero gauss region width and the zero gauss region center angle in the magnetic flux density distribution in the normal line direction of the development pole hardly change before and after the magnet block is buried in the development magnet roller, a desired development magnet roller can be obtained. Further, it is preferable that a (BH) max of the development magnet roller is greater than that of the magnet block buried in the development magnet roller. Thereby, the half-value region width in the magnetic flux density distribution in the normal line direction of the development pole can be narrowed while making the zero gauss region width relatively large. Furthermore, the magnet block may preferably include a rare earth magnet. Thereby, the surface magnetic force of the development roller necessary for development can be easily obtained. Further, the development magnet roller may be configured such that the magnet block buried in the development magnet roller protrudes from the development magnet roller. Thereby, adjusting the position where the magnet block is arranged is facilitated, so that narrowing the half-value region width in the magnetic flux density distribution in the normal line direction of the development pole can be facilitated. It is preferable that a protrusion amount of the magnet block from the development magnet roller is at least 0.2 mm. Further, parts of a circumferential surface of the development magnet roller in a vicinity of the groove into which the magnet block is buried may be made flat. Thereby, adjusting the protruding distance of the magnet block from the development magnet roller can be facilitated.

According to another preferred embodiment of the present invention, a development device including the above-described development magnet roller, a process cartridge including the development device, and an image forming apparatus including the development device are provided.

BRIEF DESCRIPTION OF THE DRAWINGS

A more complete appreciation of the present invention and many of the attended advantages thereof will be readily obtained as the same becomes better understood by reference to the following detailed description when considered in connection with the accompanying drawings, wherein:

FIG. 5 is a table expressing properties of the development magnet roller in an exemplary embodiment of the invention.

DETAILED DESCRIPTION OF THE PREFERRED EMBODIMENTS

Figure 1:
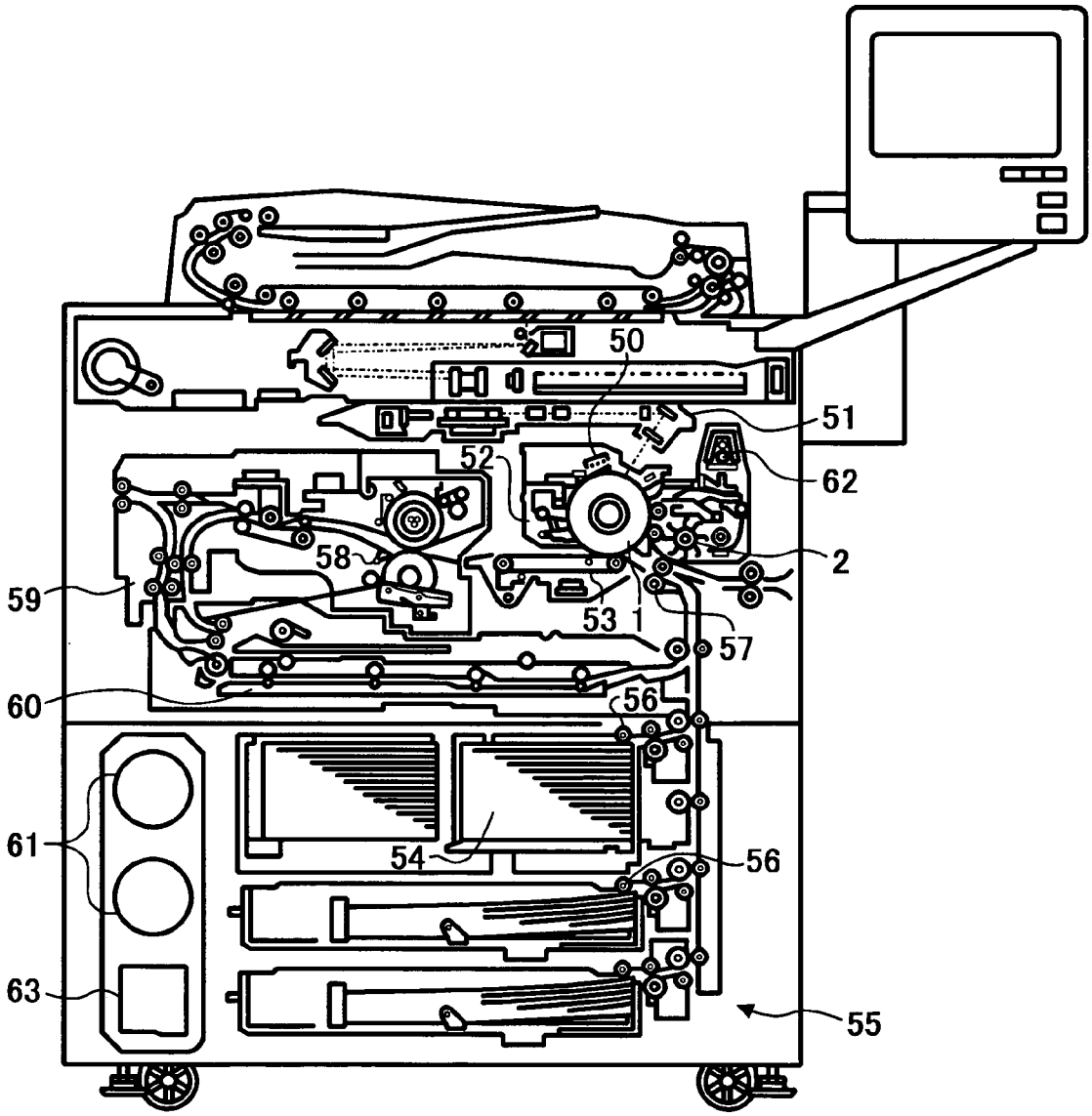
FIG. 1 is a schematic cross section of an image forming apparatus according to a preferred embodiment of the present invention.

Referring now to the drawings, wherein like reference numerals designate identical or corresponding parts throughout the several views, preferred embodiment of the present invention are described.

In a two-component development device, the magnetic waveform of a development pole of a development roller has been examined to improve carrier adhesion and trailing edge omission phenomena. First, the peak magnetic flux density (maximum magnetic force in a magnetic force distribution curve in the normal line direction) of the development pole has been examined, and it has been found that higher the peak magnetic flux density is, it is more advantageous for improving carrier adhesion. It is believed that as the peak magnetic flux density of a development pole is higher, the magnetic force in a development area is higher, so that carrier adhesion is hard to occur.

Next, the zero gauss region width (angle width at parts of a magnetic force distribution curve in the normal line direction where the normal line magnetic force is zero) of the development pole has been examined, and it has been found that greater the zero gauss region width is, it is advantageous for improving carrier adhesion. It is believed that if the zero gauss region width is too narrow, ears of developer sharply rise, which is disadvantageous for avoiding carrier adhesion. However, when the zero gauss region width is made greater, the widths of ears of developer increase, which causes trailing edge omission to increase. Trailing edge omission is caused by that toner is scraped off the latent image bearing member, so that it can be improved by making the widths of ears of developer smaller. Therefore, it has been examined in the magnetic waveform of a development pole to narrow the half-value region width while keeping the zero gauss region width relatively large. As a result, it has been found that by narrowing the half-value region width, trailing edge omission can be improved while maintaining carrier adhesion within an allowable range. It is believed that ears of developer are caused to sharply rise by narrowing the half-value region width, and thereby the widths of ears of developer contacting the latent image bearing member are made smaller, so that trailing edge omission has been improved.

As the half-value region angle between a development pole and a next pole at the downstream side of the development pole in the direction in which developer born on the surface of a development roller is conveyed is greater, the magnetic force between the development pole and the next pole rapidly plunges, which is disadvantageous for avoiding carrier adhesion. Here, the half-value region angle between the development pole and the next pole is the angle between the part of the magnetic force distribution curve in the normal line direction of the development pole at the downstream side and the part of the magnetic force distribution curve of the next pole at the upstream side, at parts respectively having values corresponding to halves of the maximum (peak) normal line magnetic forces. Therefore, it has been examined in the magnetic flux density distribution in the normal line direction of the development pole to shift the position of the half-value region center angle (angle of the center of the half-value region measured from a criterion position) to the downstream side of the zero gauss region center angle (angle of the center of the zero gauss region measured from a criterion position). As the result, it has been found that carrier adhesion can be further suppressed by shifting the position of the half-value region center angle to the downstream side of the zero gauss region center angle in the magnetic flux density distribution in the normal line direction of the development pole.

Thus, it has been found that to improve trailing edge omission while suppressing carrier adhesion, in a magnetic flux density distribution in a normal line direction of a development pole, a peak magnetic flux density should be 120 mT or greater, a zero gauss region width should be 70° or greater, and a half-value region width should be 40° or smaller. Further, it is preferable that in the magnetic flux density distribution in the normal line direction of the development pole, the half-value region center angle is located 3° or more at the downstream side of the zero gauss region center angle in the direction in which developer born on the surface of a development roller is conveyed.

FIG. 1 schematically illustrates an image forming apparatus according to a preferred embodiment of the present invention. A photoconductor drum 1 serving as a latent image bearing member is driven to rotate, and while being rotated, the surface the photoconductor drum 1 is uniformly charged by a charging device 50. Thereafter, the charged surface of the photoconductor drum 1 is scanned and exposed with an optical writing unit 51 according to image information, and thereby an electrostatic latent image is formed on the surface of the photoconductor drum 1. The electrostatic latent image on the photoconductor drum 1 is developed with toner by a development device 2 described later, and thereby a toner image is formed on the photoconductor drum 1. The toner image is transferred onto a sheet as a transfer member on a transfer belt 53 of a transfer unit. The sheet is conveyed onto the transfer belt 53 from a sheet feeding unit 55 having a tandem tray 54 via a feeding roller 56 and a registration roller pair 57. In this embodiment, a cartridge unit may be constituted with at least the photoconductor drum 1 and the development device 2. Further, a process cartridge may be constituted with the cartridge unit, a charging device, a cleaning unit, and a discharging device. A process cartridge refers to a cartridge that includes a development device and other process devices and that can be integrally attached to and detached from the main body of an image forming apparatus. Therefore, a process cartridge may be constituted only with the above-described cartridge unit, or with various combinations of a development device, a photoconductor, a charging device, and a cleaning device.

The sheet on which the toner image has been transferred is conveyed to a fixing device 58, where the toner image is fixed onto the sheet. When forming an image only on one side of a sheet, after fixing a toner image onto the sheet, the sheet is discharged. When forming an image on each side of a sheet, after a toner image has been fixed onto one side of the sheet, the sheet is conveyed, via a reverse path 59, after passing through a duplexing part 60, to the photoconductor drum 1 and the transfer unit again. Residual toner on the photoconductor drum 1 is removed with a cleaning unit 52. Residual charge on the photoconductor drum 1 is removed with a discharging lamp. Toner replenishment bottles 61 are arranged beside the sheet feeding unit 55, and toner is provided using, for example, a Monoue pump, to the development device 2 through a toner hopper 62. Residual toner is collected and stored in a discarding toner bottle 63 arranged beside the toner bottles 61.

Figure 2:
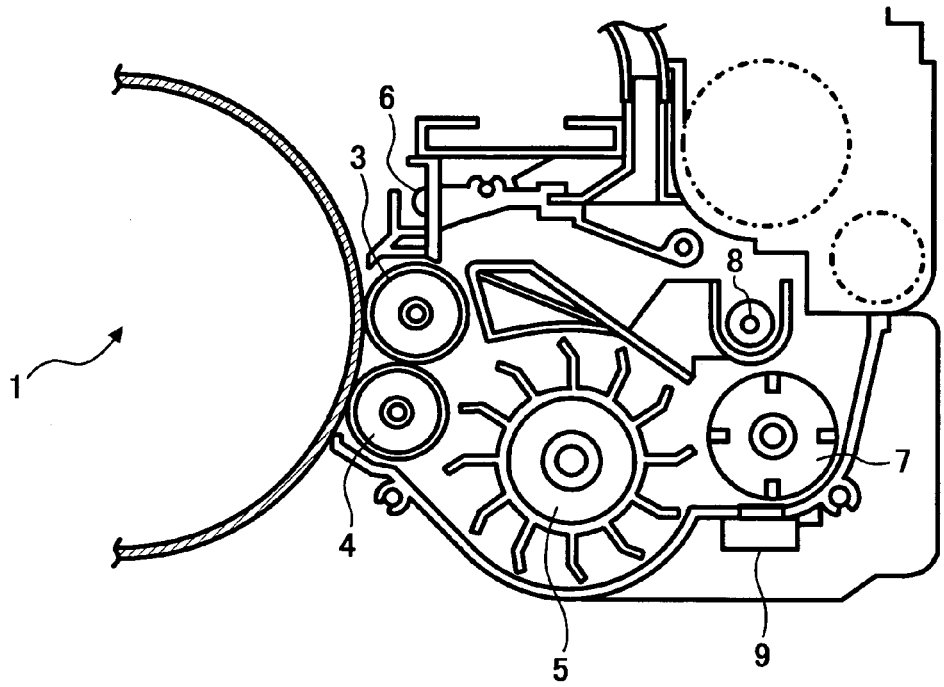
FIG. 2 is a schematic cross section a development device according to the present invention, mounted in the image forming apparatus.

FIG. 2 schematically illustrates the development device 2. The development device 2 is arranged beside the photoconductor drum 1, and a first development roller 3 and a second development roller 4, partially exposed through an opening formed at a part of a development case at the side of the photoconductor drum 1, respectively, are arranged in parallel while opposing the photoconductor drum 1 with fixed gaps relative to the photoconductor drum 1. Development sleeves of the first and second development rollers 3 and 4 are made of non-magnetic cylindrical members such as aluminum and serve as developer bearing members bearing a two-component developer including magnetic toner and magnetic carriers (hereinafter referred to as developer) on their surfaces. The development sleeves of the first and second development rollers 3 and 4 are rotated with a drive device (not shown) in a direction that the developer born on their surfaces is conveyed downward in a development area where the development sleeves of the first and second development rollers 3 and 4 oppose the photoconductor drum 1.

The development device 2 further includes a doctor 6 serving as a developer regulation member regulating the quantity of the developer born on the development sleeve of the first development roller 3 and conveyed to the development area, a paddle roller 5 configured to stir and mix developer in the development case, a stirring roller 7, a conveying screw 8 conveying replenished developer in the longitudinal direction of the stirring roller 7, and a toner sensor 9 measuring toner density in the development case to replenish toner from the toner hopper 62.

Figure 3:
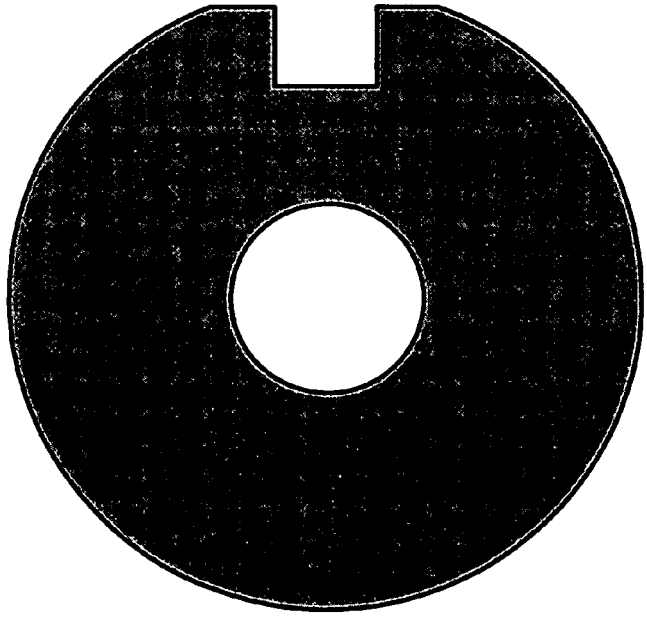
FIG. 3 is a diagram of a development magnet roller according to a preferred embodiment of the present invention used in the development device, in which parts of a circumferential surface of the development magnet roller in a vicinity of a groove into which a magnet block is buried are flat.

A magnet roller serving as a magnetic field generation device is fixedly arranged inside of each of the first and second development rollers 3 and 4. The magnet roller is formed by extrusion or injection molding of a plastic magnet, which is made by dispersing magnetic powder in plastic resin powder (high molecular compound), or a rubber magnet. By using an anisotropic substance for the magnetic powder and by applying a magnetic field in a mold in molding, magnetism is made anisotropic, and thereby a desired magnetic characteristic is obtained. A groove is formed at a part of the magnet roller corresponding to a development pole, in the longitudinal direction of the magnet roller, and a magnet block is buried into the groove. The groove may be provided by molding or cutting. As illustrated in FIG. 3, parts of the circumferential surface of the magnet roller in the vicinity of the groove may be made flat so that the magnet block buried into the groove can easily protrude by various distances from the magnet roller. The magnet roller thus obtained is magnetized with electromagnetic yokes. Six poles, for example, are formed in the magnet roller. However, eight or ten poles may be formed as necessary.

Figure 4:
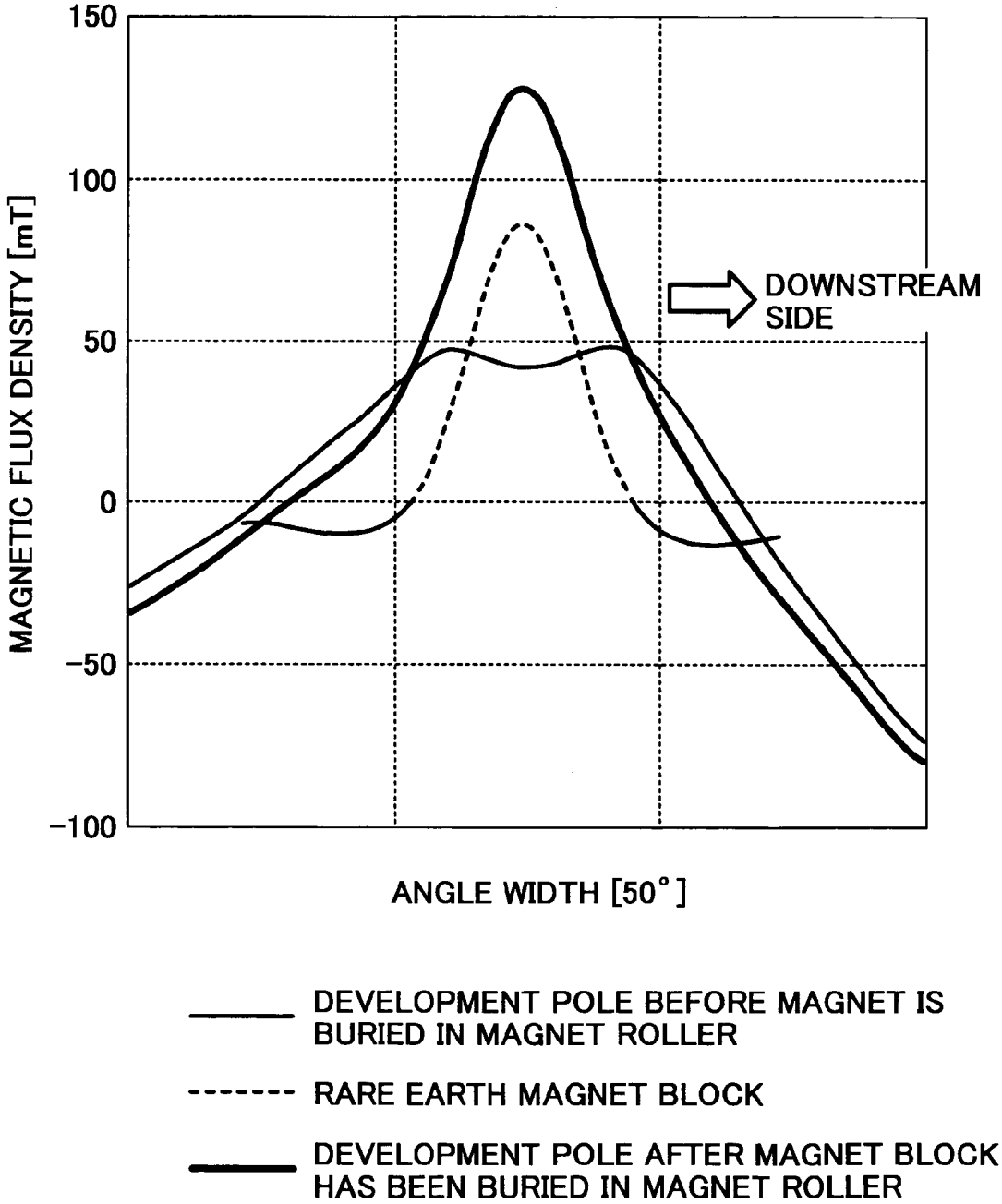
FIG. 4 is a graph explaining a magnetic waveform of a development pole of the development magnet roller.
Figure 6:
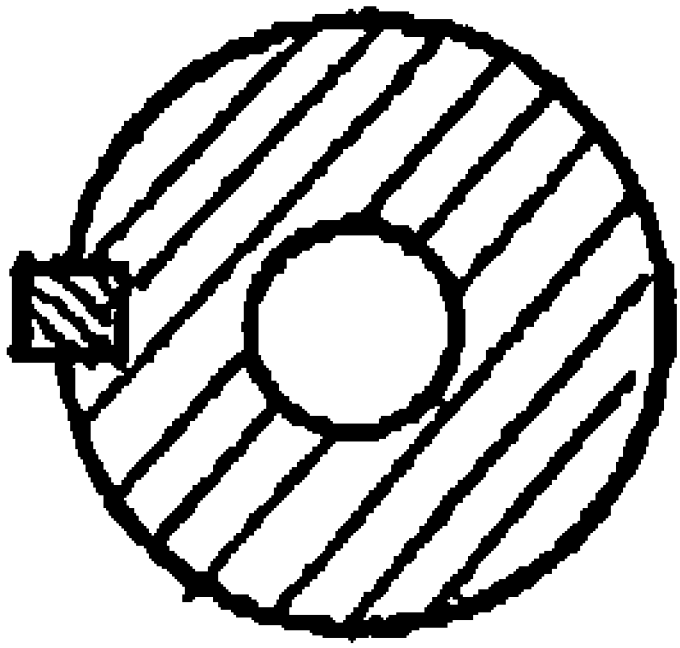
FIG. 6 is a schematic cross section of the development magnet roller including a protruding magnet block.

The zero gauss region width in a magnetic flux density distribution in the normal line direction of a development pole of a magnet roller after a magnet block has been arranged in the magnet roller depends on the zero gauss region width before the magnet block has been arranged. Therefore, in magnetizing the magnet roller (plastic magnet), the zero gauss region width in the magnetic flux density distribution in the normal line direction of the development pole is made 70° or greater. The magnet block is arranged and fixed by adhesion in the groove of the magnet roller that has been magnetized. In order to narrow a half-value region width in the magnetic flux density distribution in the normal line direction of the development pole after the magnet block has been arranged in the groove of the magnet roller, the magnet block preferably has a (BH) max greater than that of the magnet roller (plastic magnet) and includes a rare earth magnet as magnetic powder. In particular, an Nd—Fe—B magnet, which can obtain a (BH) max of 10 MGOe or greater by making magnetism anisotropic, is suitable for the magnetic powder. The development pole configured as described above has a magnetic waveform as indicated in FIG. 4, because the zero gauss region width in the magnetic flux density distribution in the normal line direction of the development pole before the magnet block is arranged in the magnet roller (plastic roller) is relatively large and the half-value region width in the magnetic flux density distribution of the magnet block is relatively small.

The half-value region center angle in the magnetic flux density distribution in the normal line direction of a development pole of a magnet roller after a magnet block has been arranged in a groove of the magnet roller depends on the position where the magnet block has been arranged in the groove of the magnet roller. Further, the half-value region width can be easily made narrower by causing the magnet block to protrude from the magnet roller. In order to make the half-value region center angle in the magnetic flux density distribution in the normal line direction of the development pole after the magnet block has been arranged in the groove of the magnet roller to be at the downstream side of the zero gauss region center angle, the position where the magnet block must be arranged in the groove of the magnet roller such that the center line of the magnet block is preferably 3° or more at the downstream side, in the direction in which developer born on the surface of the development roller is conveyed, of the zero gauss region center angle in the magnetic flux density distribution in the normal line direction of the development pole before the magnet block is arranged in the groove of the magnet roller. Thus, the development pole of a magnet roller in which a magnet block has been arranged can have a magnetic flux density distribution in the normal line direction formed such that a zero gauss region width is 70° or greater, a half-value region center angle is 40° or smaller, and the half-value region center angle is located at the downstream side of the zero gauss region center angle. Thereafter, the magnet roller is covered with a sleeve of a non-magnetic member, and thereby a development roller of the present invention is obtained.

By using a development roller of the present invention as described above, a development device improving carrier adhesion and trailing edge omission can be obtained. When the development roller of the present invention is used only for one of two development rollers in a development device, by using the development roller of the present invention at the downstream side in the direction in which developer is conveyed in a development area of an image forming apparatus, reliability of the development device can be increased and a higher image quality can be obtained with the development device.

For confirming an effect of a development roller of the present invention, carrier adhesion and trailing edge omission have been evaluated in an image forming apparatus configured as described above except that one development roller of the present invention is used in a development device, and a result of which is indicated in Table 1. The linear velocity of a photoconductor drum is set at 500 mm/sec, a development roller is driven at 900 rpm, the linear velocity ratio of the development roller and the photoconductor drum is set at 1.9, the charging potential is set at −900V, and the development bias is set at −650V.

A magnet roller of the development roller is made of PA6+Sr ferrite and has the outer diameter of 18 mm and the (BH) max of 2 MGOe. A metal core of the development roller is made of SUM22 with electro-less nickel plating and has the outer diameter of 6 mm. A magnet block of the magnet roller is made of PA6+Nd—Fe—B, and has a cross section of 3 mm×3 mm and the (BH) max of 9 MGOe. A development sleeve of the development roller is made of A6063 and has the outer diameter of 20 mm. The magnetic force of the magnetized magnet roller (plastic magnet) at a part corresponding to the development pole (i.e., base magnetic force) is 45-55 mT, and the magnetic force of the magnet block is 70-80 mT. Carrier adhesion and trailing edge omission have been evaluated while changing the magnetic flux density, the half-value region width, the zero gauss region width, and the shifting distance of the half-value region center angle relative to the zero gauss region center angle toward the downstream side in the direction in which developer is conveyed. With respect to measurement of magnetic characteristics, the magnetic flux density distribution in the normal line direction has been measured by digging a magnetic probe into the development sleeve.

TABLE 1

| | magnetic flux density [mT] | half-value region width [deg] | zero gauss region width [deg] | half-value region center angle shifting distance [deg] | magnet block protrusion amount [mm] | carrier adhesion rank | trailing edge omission rank |
|---|---|---|---|---|---|---|---|
| Ex. 1 | 132 | 31 | 54 | 1 | 0.25 | X | ○ |
| Ex. 2 | 128 | 33 | 59 | 1 | 0.25 | □ | ○ |
| Ex. 3 | 127 | 34 | 64 | 1 | 0.25 | □ | ○ |
| Ex. 4 | 133 | 33 | 71 | 1 | 0.25 | ○ | ○ |
| Ex. 5 | 132 | 33 | 76 | 1 | 0.25 | ○ | ○ |
| Ex. 6 | 131 | 34 | 79 | 1 | 0.25 | ○ | ○ |
| Ex. 7 | 129 | 33 | 76 | 3 | 0.25 | □ | ○ |
| Ex. 8 | 126 | 33 | 76 | 5 | 0.25 | □ | ○ |
| C. Ex. 1 | 115 | 41 | 68 | 0 | 0 | X | X |
| C. Ex. 2 | 103 | 45 | 65 | 0 | magnet block is not buried | X | X |

In Table 1, with respect to carrier adhesion rank, the mark of □ indicates that the number of adhered carriers is 5 or less, the mark of ○ indicates that the number of adhered carriers is 5-10, the mark of □ indicates that the number of adhered carriers is 10-15, and the mark of X indicates that the number of adhered carriers is 15 or more, in an image of A3 size. With respect to trailing edge omission rank, the degree of trailing edge omission has been evaluated at 9 grades from 1.0 (unsatisfactory) to 5.0 (satisfactory) at intervals of 0.5, and the mark of ○ indicates that the grade is 4.0 or above, the mark of □ indicates that the grade is 3.0 or 3.5, and the mark of X indicates that the grade is 2.5 or below. "C. Ex." stands for comparative example.

In examples 1-8, a magnet block has been buried in the magnet roller such that the magnet block protrudes 0.25 mm from the magnet roller. In comparative example 1, a magnet block has been buried in the magnet roller such that the magnet block does not protrude from the magnet roller. In comparative example 2, a magnet block has not been buried in the magnet roller.

Satisfactory results have been obtained with respect to carrier adhesion and trailing edge omission in examples 4-8 in which, in the magnetic flux density distribution in the normal line direction of the development pole, a peak magnetic flux is 120 mT or greater, a zero gauss region width is 70° or greater, and a half-value region width is 40° or smaller. In examples 7 and 8 in which, in the magnetic flux density distribution in the normal line direction of the development pole, the half-value region center angle is shifted 3° or more toward the downstream side of the zero gauss region center angle in the direction in which the developer is conveyed, more satisfactory results have been obtained.

Numerous additional modifications and variations of the present invention are possible in light of the above teachings. It is therefore to be understood that within the scope of the appended claims, the present invention can be otherwise practiced than as specifically described herein.

What is claimed is:

1. A development magnet roller configured for use in a development roller of an electrophotographic image forming apparatus, the development magnet roller comprising:

a development sleeve; and a development pole configured to form a magnetic field causing a developer on a surface of the sleeve of the development roller to rise in a form of a series of ears in a development area of the image forming apparatus where the development roller opposes an image bearing member, wherein (a) in a magnetic flux density distribution in a normal line direction of the development pole, a peak magnetic flux density is 120 mT or greater, a zero gauss region width is 70° or greater, and a half-value region width is 40° or smaller; and (b) said zero gauss region width is measured on the surface of the development sleeve.

2. The development magnet roller according to claim 1, wherein the magnetic flux density distribution in the normal line direction of the development pole is formed such that a half-value region center angle is shifted 3° or more toward a downstream side of a zero gauss region center angle in a direction in which the developer born on the surface of the development roller is conveyed.

3. The development magnet roller according to claim 1, further comprising:

a magnet block buried in a part of the development magnet roller corresponding to the development pole.

4. The development magnet roller according to claim 3, wherein the magnet block is buried in a groove formed at said part of the development magnet roller corresponding to the development pole.

5. The development magnet roller according to claim 4, wherein parts of a circumferential surface of the development magnet roller in a vicinity of the groove into which the magnet block is buried are flat.

6. The development magnet roller according to claim 3, wherein in a magnetic flux density distribution in a normal line direction of the development pole before the magnet block is buried in said part of the development magnet roller, a zero gauss region width is 70° or greater, a center line of the magnet block buried in said part of the development magnet roller is located 3° or more shifted toward a downstream side of a zero gauss region center angle in the magnetic flux density distribution in the normal line direction of the development pole before the magnet block is buried in the development magnet roller, and said downstream side is in a direction in which the developer born on the surface of the development roller is conveyed.

7. The development magnet roller according to claim 3, wherein a (BH) max of the development magnet roller is greater than that of the magnet block buried in the development magnet roller.

8. The development magnet roller according to claim 3, wherein the magnet block includes a rare earth magnet.

9. The development magnet roller according to claim 3, wherein the magnet block buried in the development magnet roller protrudes from the development magnet roller.

10. The development magnet roller according to claim 9, wherein a protrusion amount of the magnet block from the development magnet roller is at least 0.2 mm.

11. A development device of an electrophotographic image forming apparatus, comprising:

a development sleeve configured to bear a developer on a surface thereof; and a development magnet roller fixedly arranged in the development sleeve and having a development pole configured to form a magnetic field causing the developer on the surface of the development sleeve to rise in a form of a series of ears in a development area of the image forming apparatus where the development sleeve opposes an image bearing member, wherein (a) in a magnetic flux density distribution in a normal line direction of the development pole, a peak magnetic flux density is 120mT or greater, a zero gauss region width is 70° or greater, and a half-width region width is 40° or smaller; and (b) said zero gauss region width is measured on the surface of the development sleeve.

12. The development device according to claim 11, wherein the magnetic flux distribution in the normal line direction of the development pole is formed such that a half-value region center angle is shifted 3° or more toward a downstream side of a zero gauss region center angle in a direction in which the developer born on the surface of the development sleeve is conveyed.

13. The development device according to claim 11, wherein in the magnetic flux density distribution in the normal line direction of the development pole, a half-value region center angle is located at an upstream side, in a direction in which the developer born on the surface of the development sleeve is conveyed, of a part of the development magnet roller most adjacent to the image bearing member.

14. The development device according to claim 11, further comprising:

a magnet block buried in a part of the development magnet roller corresponding to the development pole.

15. The development device according to claim 14, wherein the magnet block buried in the development magnet roller protrudes from the development magnet roller.

16. The development device according to claim 15, wherein a protrusion amount of the magnet block from the development magnet roller is at least 0.2 mm.

17. The development device according to claim 14, wherein the magnet block is buried into a groove formed at the part of the development magnet roller corresponding to the development pole.

18. The development device according to claim 17, wherein parts of a circumferential surface of the development magnet roller in a vicinity of the groove into which the magnet block is buried are flat.

19. The development device according to claim 14, wherein in a magnetic flux density distribution in a normal line direction of the development pole before the magnet block is buried in said part of the development magnet roller, a zero gauss region width is 70° or greater, a center line of the magnet block buried in said part of the development magnet roller is located 3° or more shifted toward a downstream side of a zero gauss region center angle in the magnetic flux density distribution in the normal line direction of the development pole before the magnet block is buried in the development magnet roller, and said downstream side is in a direction in which the developer born on the surface of the development roller is conveyed.

20. The development device according to claim 14, wherein a (BH) max of the development magnet roller is greater than that of the magnet block buried in the development magnet roller.

21. The development device according to claim 14, wherein the magnet block includes a rare earth magnet.

22. A development device of an electrophotographic image forming apparatus, comprising:

an image bearing member;

a plurality of development rollers;

an image forming area where the plurality of development rollers oppose said image bearing member; and a development case housing the plurality of development rollers to be partially exposed, wherein said plurality of development rollers each include a development sleeve and a development roller located at a downstream side in a direction in which a developer is conveyed in said development area, said development roller including, a development magnet roller having a development pole configured to form a magnetic field causing a developer on a surface of the development sleeve of the development roller to rise in a form of a series of ears in the development area, wherein (a) in a magnetic flux density distribution in a normal line direction of the development pole, a peak magnetic flux density is 120 mT or greater, a zero gauss region width is 70° or greater a half-value region width is 40° or smaller (b) said zero gauss region width is measured on the surface of the development sleeve.

23. The development device according to 22, wherein the magnetic flux density distribution in the normal line direction of the development pole is formed such that a half-value region center angle is shifted 3° or more toward a downstream side of a zero gauss region center angle in a direction in which the developer born on the surface of the development roller is conveyed.

24. The development device according to claim 22, wherein in the magnetic flux density distribution in the normal line direction of the development pole, a half-value region center angle is located at an upstream side, in a direction in which the developer born on the surface of the development roller is conveyed, of a part of the development magnet roller most adjacent to the image bearing member.

25. The development device according to claim 22, wherein said development magnetic roller further comprises:

a magnet block buried in a part of the development magnet roller corresponding to the development pole.

26. The development device according to claim 25, wherein the magnet block is buried into a groove formed at the part of the development magnet roller corresponding to the development pole.

27. The development device according to claim 26, wherein parts of a circumferential surface of the development magnet roller in a vicinity of the groove into which the magnet block is buried are flat.

28. The development device according to claim 25, wherein in a magnetic flux density distribution in a normal line direction of the development pole before the magnet block is buried in said part of the development magnet roller, a zero gauss region width is 70° or greater, a center line of the magnet block buried in said part of the development magnet roller is located 3° or more shifted toward a downstream side of a zero gauss region center angle in the magnetic flux density distribution in the normal line direction of the development pole before the magnet block is buried in the development magnet roller, and said downstream side is in a direction in which the developer born on the surface of the development roller is conveyed.

29. The development device according to claim 25, wherein a (BH) max of the development magnet roller is greater than that of the magnet block buried in the development magnet roller.

30. The development device according to claim 25, wherein the magnet block includes a rare earth magnet.

31. The development device according to claim 25, wherein the magnet block buried in the development magnet roller protrudes from the development magnet roller.

32. The development device according to claim 31, wherein a protrusion amount of the magnet block from the development magnet roller is at least 0.2 mm.

33. A process cartridge of an electrophotographic image forming apparatus, comprising:

a development device including a development roller having a development magnet roller and a development sleeve; and a process device, wherein (a) the development magnet roller has a development pole configured to form a magnetic field causing a developer on a surface of the development sleeve of the development roller to rise in a form of a series of ears in a development area of the image forming apparatus where the development roller opposes an image bearing member, (b) in a magnetic flux density distribution in a normal line direction of the development pole, a peak magnetic flux density is 120 mT or greater, a zero gauss region width is 70° or greater and a half-value region width is 40° or smaller; and (c) said zero gauss region width is measured on the surface of the development sleeve.

34. The process cartridge according to claim 33, wherein the magnetic flux density distribution in the normal line direction of the development pole is formed such that a half-value region center angle is shifted 3" or more toward a downstream side of a zero gauss region center angle in a direction in which the developer born on the surface of the development roller is conveyed.

35. The process cartridge according to claim 33, wherein said development magnetic roller further comprises:

a magnet block buried in a part of the development magnet roller corresponding to the development pole.

36. The process cartridge according to claim 35, wherein the magnet block is buried into a groove formed at the part of the development magnet roller corresponding to the development pole.

37. The process cartridge according to claim 35, wherein in a magnetic flux density distribution in a normal line direction of the development pole before the magnet block is buried in said part of the development magnet roller, a zero gauss region width is 70° or greater, a center line of the magnet block buried in said part of the development magnet roller is located 3° or more shifted toward a downstream side of a zero gauss region center angle in the magnetic flux density distribution in the normal line direction of the development pole before the magnet block is buried in the development magnet roller, and said downstream side is in a direction in which the developer born on the surface of the development roller is conveyed.

38. The process cartridge according to claim 35, wherein a (BH) max of the development magnet roller is greater than that of the magnet block buried in the development magnet roller.

39. The process cartridge according to claim 35, wherein the magnet block includes a rare earth magnet.

40. The process cartridge according to claim 35, wherein the magnet block buried in the development magnet roller protrudes from the development magnet roller.

41. The process cartridge according to claim 40, wherein a protrusion amount of the magnet block from the development magnet roller is at least 0.2 mm.

42. The process cartridge according to claim 41, wherein parts of a circumferential surface of the development magnet roller in a vicinity of the groove into which the magnet block is buried are flat.

43. An image forming apparatus of electrophotography, comprising:

an image bearing member; and a development device including a development roller having a development magnet roller and a development sleeve, wherein (a) the development magnet roller has a development pole configured to form a magnetic field causing a developer on a surface of the development sleeve of the development roller to rise in a form of a series of ears in a development area where the development roller opposes the image bearing member, (b)in a magnetic flux density distribution in a normal line direction of the development pole, a peak magnetic flux density is 120 mT or greater, a zero gauss region width is 70° or greater, and a half-value region width is 40° or smaller; and (c) said zero gauss region width is measured on the surface of the development sleeve.

44. The image forming apparatus according to claim 43, wherein the magnetic flux density distribution in the normal line direction of the development pole is formed such that a half-value region center angle is shifted 3° or more toward a downstream side of a zero gauss region center angle in a direction in which the developer born on the surface of the development roller is conveyed.

45. The image forming apparatus according to claim 43, wherein the development magnet roller further comprises:

a magnet block is buried in a part of the development magnet roller corresponding to the development pole.

46. The image forming apparatus according to claim 45, wherein the magnet block is buried into a groove formed at the part of the development magnet roller corresponding to the development pole.

47. The image forming apparatus according to claim 46, wherein parts of a circumferential surface of the development magnet roller in a vicinity of the groove into which the magnet block is buried are flat.

48. The image forming apparatus according to claim 45, wherein in a magnetic flux density distribution in a normal line direction of the development pole before the magnet block is buried in said part of the development magnet roller, a zero gauss region width is 70° or greater, a center line of the magnet block buried in said part of the development magnet roller is located 3° or more shifted toward a downstream side of a zero gauss region center angle in the magnetic flux density distribution in the normal line direction of the development pole before the magnet block is buried in the development magnet roller, and said downstream side is in a direction in which the developer born on the surface of the development roller is conveyed.

49. The image forming apparatus according to claim 45, wherein a (BH) max of the development magnet roller is greater than that of the magnet block buried in the development magnet roller.

50. The image forming apparatus according to claim 45, wherein the magnet block includes a rare earth magnet.

51. The image forming apparatus according to claim 45, wherein the magnet block buried in the development magnet roller protrudes from the development magnet roller.

52. The image forming apparatus according to claim 51, wherein a protrusion amount of the magnet block from the development magnet roller is at least 0.2 mm.

* * * * *